US007077340B2

(12) United States Patent
Boecking

(10) Patent No.: US 7,077,340 B2
(45) Date of Patent: Jul. 18, 2006

(54) FUEL INJECTION VALVE FOR INTERNAL COMBUSTION ENGINES

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/528,464

(22) PCT Filed: May 23, 2003

(86) PCT No.: PCT/DE03/01679

§ 371 (c)(1),
(2), (4) Date: Mar. 21, 2005

(87) PCT Pub. No.: WO2004/040124

PCT Pub. Date: May 13, 2004

(65) Prior Publication Data

US 2006/0032947 A1 Feb. 16, 2006

(30) Foreign Application Priority Data

Oct. 22, 2002 (DE) ..... 102 49 144

(51) Int. Cl.
*F02M 61/00* (2006.01)

(52) U.S. Cl. ..... 239/533.12; 239/533.3

(58) Field of Classification Search ..... 123/470, 123/472, 198 D; 239/533.12, 533.11, 533.3, 239/585.5

See application file for complete search history.

(56) References Cited

U.S. PATENT DOCUMENTS

| | | | | |
|---|---|---|---|---|
| 1,952,816 | A * | 3/1934 | Mock | 239/488 |
| 2,927,737 | A * | 3/1960 | Zeuch et al. | 239/533.3 |
| 6,257,506 | B1 * | 7/2001 | Hofmann et al. | 239/533.2 |
| 6,427,932 | B1 * | 8/2002 | Danckert et al. | 239/533.12 |
| 6,565,017 | B1 * | 5/2003 | Fath et al. | 239/533.3 |

FOREIGN PATENT DOCUMENTS

| | | |
|---|---|---|
| AT | 389 352 B | 11/1989 |
| DE | 30 14 958 A | 10/1981 |
| DE | 196 09 218 A | 9/1997 |
| DE | 100 31 265 A | 1/2002 |
| GB | 445 873 A | 4/1936 |
| GB | 726 248 A | 3/1955 |

* cited by examiner

*Primary Examiner*—Carl S. Miller
(74) *Attorney, Agent, or Firm*—Ronald E. Greigg

(57) ABSTRACT

A fuel injection valve with a valve body that contains a bore delimited at its end oriented toward the combustion chamber by a valve seat and whose end region oriented toward the combustion chamber has at least one injection opening. A piston-shaped valve needle is contained in the bore in a longitudinally sliding fashion and has an essentially conical valve sealing surface by means of which the valve needle cooperates with the valve seat in order to control the at least one injection opening. The valve seat has a first conical partial surface and a second conical partial surface wherein the second conical partial surface is disposed downstream of the first conical partial surface and is raised in relation to it.

5 Claims, 3 Drawing Sheets

FUEL INJECTION VALVE FOR INTERNAL COMBUSTION ENGINES

CROSS-REFERENCE TO RELATED APPLICATIONS

This application is a 35 USC 371 application of PCT/DE 03/01679 filed on May 23, 2003.

BACKGROUND OF THE INVENTION

1. Field of the Invention

The invention is directed to an improved fuel injection valve for internal combustion engines.

2. Description of the Prior Art

A fuel injection valve of the type with which this invention is concerned is described, for example, in the patent application DE 100 31 265 A1 and has a valve body that contains a bore delimited its end oriented toward the combustion chamber by a valve seat that has at least one injection opening leading from it, which feeds into the combustion chamber of the engine in the installed position of the fuel injection valve. The bore contains a piston-shaped valve needle in a longitudinally sliding fashion, which has a valve sealing surface at its combustion chamber end, i.e. the end oriented toward the valve seat, and this valve sealing surface of the valve needle cooperates with the valve seat. In the closed position of the valve needle, i.e. when the valve needle is resting with its valve sealing surface against the valve seat, the injection openings are closed, whereas when the valve needle is lifted away from the valve seat, fuel flows between the valve sealing surface and the valve seat, through the injection openings, and from there, is injected into the combustion chamber of the engine.

The longitudinal movement of the valve needle in the bore is the result of the ratio between two forces: on the one hand, a hydraulic force that is generated by the pressure in the fuel-filled pressure chamber formed between the wall of the bore and the valve needle so that a hydraulic force is exerted on the valve needle. On the other hand, a suitable device that acts on the end of the valve needle oriented away from the combustion chamber exerts a closing force on the valve needle. The hydraulic force on the valve needle depends on the effective area that is acted on by the fuel, which yields a force component in the longitudinal direction. The opening pressure of the fuel injection valve, i.e. the fuel pressure in the pressure chamber at which the hydraulic force on the valve needle is sufficient to move it in the longitudinal direction away from the valve seat counter to an opposing closing force therefore depends, among other things, on the contact line between the valve needle and the valve seat, i.e. the so-called hydraulically effective seat diameter, because this affects the partial area of the valve sealing surface that is subjected to the fuel pressure. Wear between the valve sealing surface and the valve seat over the life of the fuel injection valve causes a change in this area, thus altering the hydraulically effective seat diameter. This also changes the opening pressure, which results in a changed opening dynamic of the valve needle. This also changes the injection time and injection quantity of fuel, which can lead to problems in modern, high-speed internal combustion engines, particularly with regard to fuel consumption and emissions.

SUMMARY AND ADVANTAGES OF THE INVENTION

The fuel injection valve according to the invention, has the advantage over the prior art that without changing the geometry of the valve needle, a constant opening pressure can be maintained over the entire service life of the fuel injection valve. To this end, the valve seat has two conical partial surfaces, the second conical partial surface downstream of the first conical partial surface. The second conical partial surface is raised in relation to the first conical partial surface so that in the closed position, the valve needle comes into contact with the second conical partial surface and the edge at the transition between the first conical partial surface and the second conical partial surface defines the hydraulically effective seat diameter.

Advantageous modifications of the subject of the invention are disclosed.

In a first advantageous embodiment of the subject of the invention, the second conical partial surface has the same cone angle as the first conical partial surface. As a result, the two conical partial surfaces can be produced with the same tool, which eliminates the need to readjust the milling or grinding tool during manufacture.

In another advantageous embodiment, the second conical partial surface is raised in relation to the first conical partial surface, preferably by 2 mm to 20 mm. Providing a step of this kind assures a constant opening pressure without changing the stability ratios in the valve body in the region of the valve seat.

In another advantageous embodiment, a third conical partial surface is embodied on the valve seat downstream of the second conical partial surface and is recessed in relation to the second conical partial surface. As a result, the valve seat surface against which the valve needle can rest is also delimited by a step on the downstream side. This results in precisely defined hydraulic ratios at the contact area between the valve needle and the valve seat.

The embodiments of the valve seat according to the invention are particularly advantageous if the valve needle has a sealing edge that is embodied between two conical sealing surfaces and rests against the second conical partial surface when the valve needle is in the closed position. This assures the constant opening pressure, even over very long periods of operation.

BRIEF DESCRIPTION OF THE DRAWINGS

The above and other features of the invention will become apparent from the detailed description contained herein below, taken in conjunction with the drawings, in which.

DESCRIPTION OF THE PREFERRED EMBODIMENTS

Figure 1:
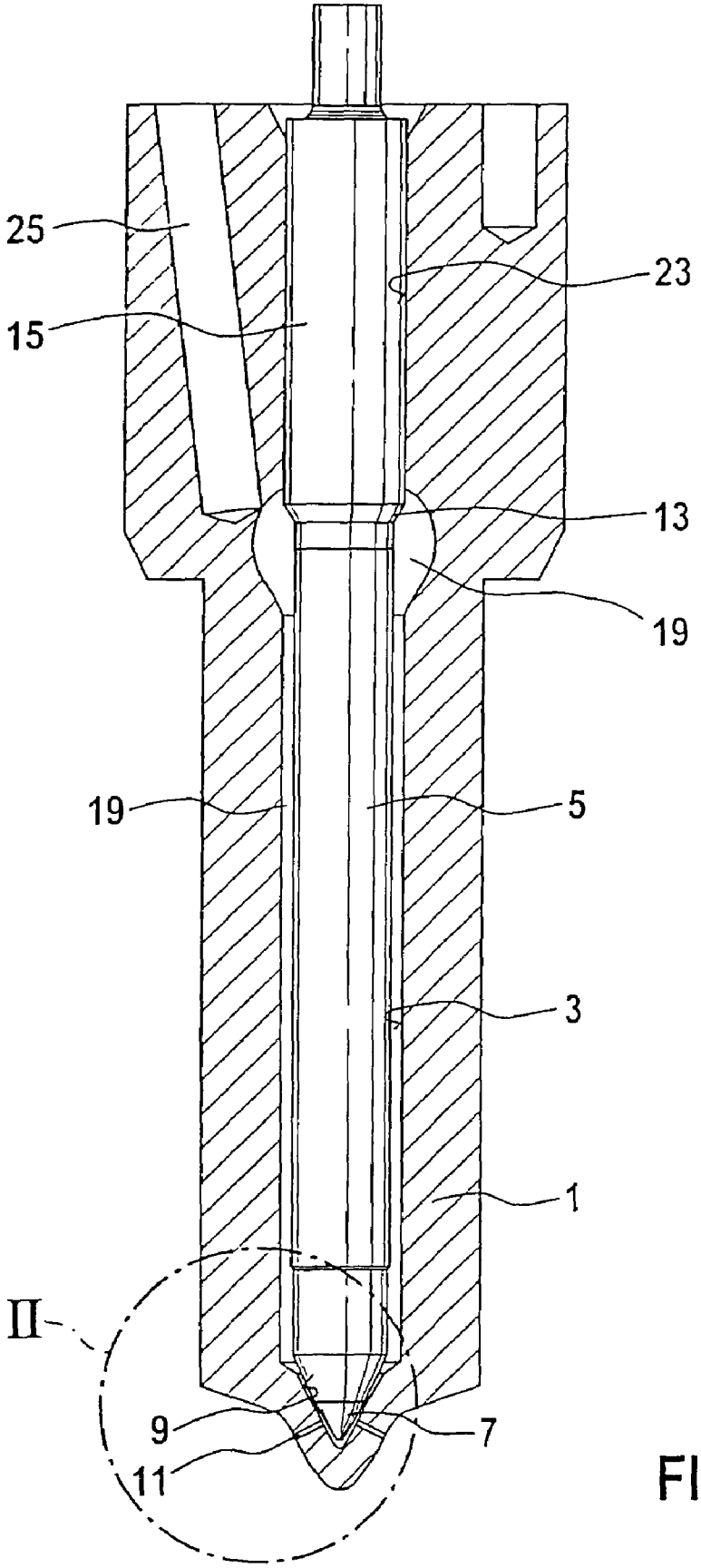
FIG. 1 shows a longitudinal section through a fuel injection valve.

FIG. 1 shows a longitudinal section through a fuel injection valve according to the invention. A valve body 1 has a bore 3 in which a piston-shaped valve needle 5 is guided in a longitudinally sliding fashion. The valve needle 5 is guided here in a sealed fashion with a guide section 15 oriented away from the combustion chamber in a guide section 23 of the bore 3. Starting from the guide section 15, the valve needle 5 tapers toward the combustion chamber, forming a pressure shoulder 13 and, at its combustion chamber end, transitions into an essentially conical valve sealing surface 7. Between the valve needle 5 and the wall of the bore 3, a pressure chamber 19 is formed, which widens out radially at the level of the pressure shoulder 13. This radial expansion of the pressure chamber 19 is fed by a supply bore 25 that extends in the valve body 1 and can supply highly pressurized fuel to the pressure chamber 19. At its end oriented toward the combustion chamber, the bore 3 is delimited by a valve seat 9 that has at least one injection opening 11 extending from it, which feeds into the combustion chamber of an engine in the installed position of the fuel injection valve.

Figure 2:
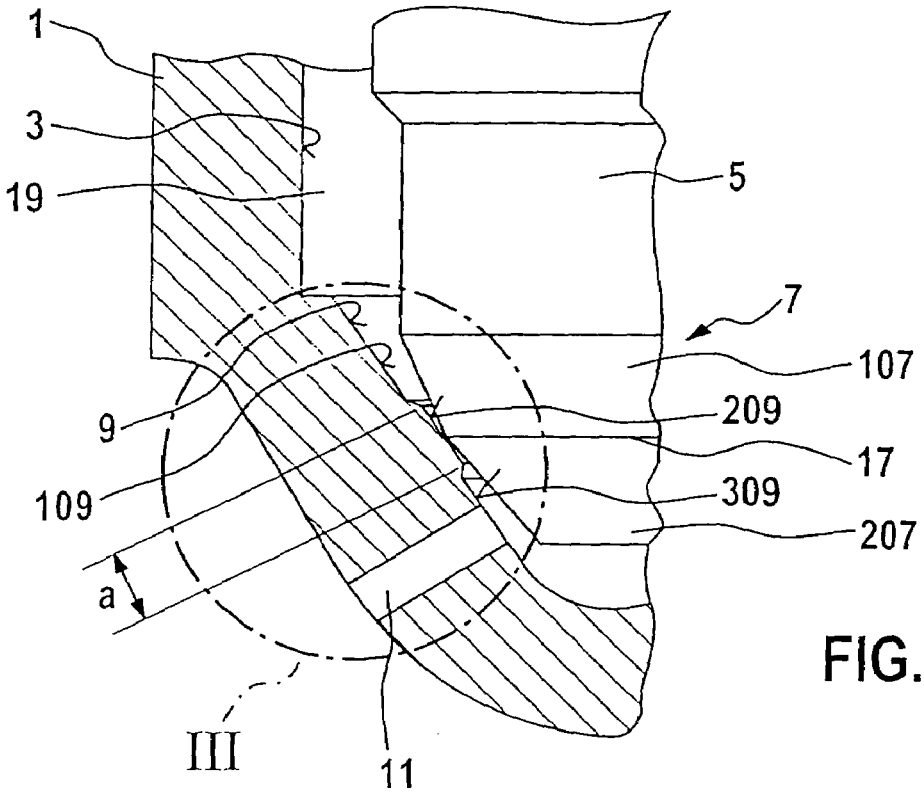
FIG. 2 shows an enlargement of the detail labeled II from FIG. 1, in the region of the valve seat.

FIG. 2 shows an enlargement of the detail labeled II from FIG. 1. The valve sealing surface 7 of the valve needle 5 is divided into a first conical sealing surface 107 and a second conical sealing surface 207, with a sealing edge 17 formed at the transition between them due to the differing cone angles of the two conical sealing surfaces 107, 207. The valve seat 9 is essentially conically embodied and has three conical partial surfaces: the first conical partial surface 109 is adjoined by the second conical partial surface 209, which is in turn adjoined by the third conical partial surface 309. The second conical partial surface 209 is raised in relation to the first conical partial surface 109 and is positioned in relation to the valve needle 5 so that in the closed position of the valve needle 5, when the needle is resting against the valve seat 9, the sealing edge 17 rests against the second conical partial surface 209.

Figure 3:
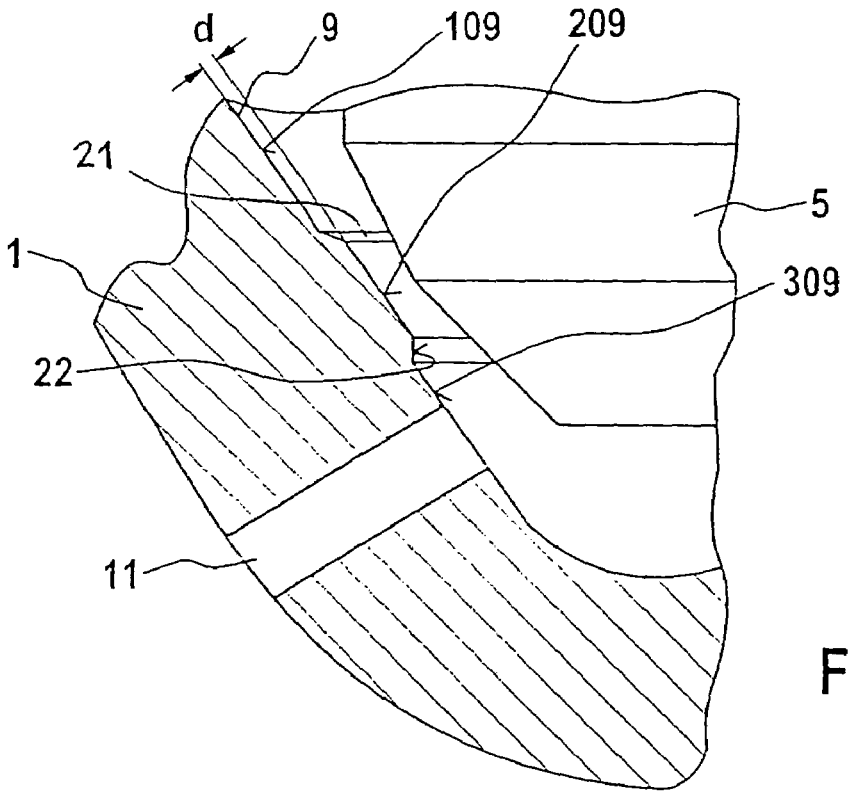
FIG. 3 shows an enlargement of the detail labeled III from FIG. 2.

FIG. 3 shows an enlargement of the detail labeled III from FIG. 2, i.e. an even larger depiction of the crucial part of the valve seat 9. Between the first conical partial surface 109 and the second conical partial surface 209, a first annular step 21 is formed, which delimits the hydraulically effective seat diameter. This plays a decisive role for the opening behavior of the fuel injection valve; the longitudinal movement of the valve needle 5 in the bore 3 is determined by the ratio of two forces: on the one hand, a closing force that a suitable device, not shown in the drawing, exerts on the end of the valve needle oriented away from the combustion chamber. On the other hand, the valve needle 5 is subjected to a hydraulic opening force that is oriented counter to the closing force and is exerted on the valve needle 5 by the fuel pressure in the pressure chamber 19. The areas of the valve needle 5, which, when subjected to pressure, produce a resulting force component in the longitudinal direction, are primarily the pressure shoulder 13 and parts of the valve sealing surface 7. If the closing force is constant, then it defines the opening pressure, i.e. the fuel pressure in the fuel chamber 19 at which the valve needle 5 begins its opening stroke motion.

With ideally fixed ratios, i.e. if neither the valve needle 5 nor the valve seat 9 were to be deformed, then the sealing edge 17 of the valve needle 5 would define the hydraulically effective seat diameter. The total area of the valve seat surface 7 upstream of the sealing edge 17, i.e. the first conical sealing surface 107 in this exemplary embodiment, would be acted on by the fuel pressure, thus determining the hydraulic opening pressure. But because the valve needle 5 hammers into the valve needle 9, over time, a flat contact develops between the valve sealing surface 7 and the valve seat 9, thus also changing the hydraulically effective seat diameter in a way that reduces the area subjected to pressure, which causes the opening pressure to increase. But the design of the raised second conical partial surface 209 on the valve seat 9 limits the increase of this hydraulic seat diameter to the first annular step 21 so that the opening pressure remains unchanged even over extended operation of the fuel injection valve. The second annular step 22 embodied between the second conical partial surface 209 and the third conical partial surface 309 delimits the area against which the valve needle 5 rests at the end oriented toward the injection openings so that precisely defined hydraulic ratios prevail at the valve seat. Adhesive forces possibly occurring between the valve needle and valve seat thus remain constant.

Figure 4:
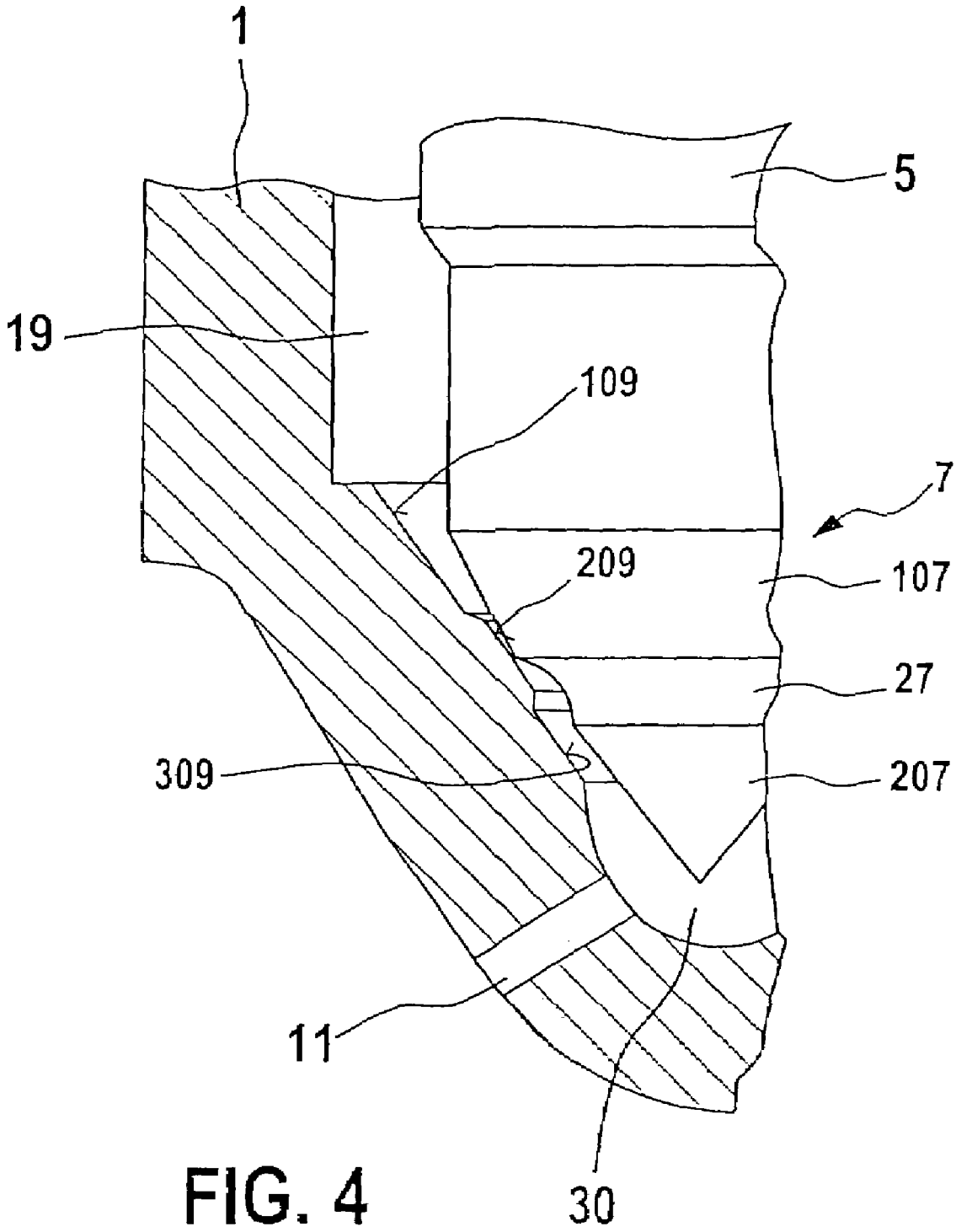
FIG. 4 shows the same detail as FIG. 2, but in this instance, the fuel injection valve is embodied as a so-called blind hole nozzle in the region of the valve seat.

FIG. 4 shows the same detail as FIG. 2 of a different fuel injection valve, which has a slightly altered seat geometry. As in the exemplary embodiment shown in FIG. 2 and FIG. 3, the third conical partial surface 309 is recessed in relation to the second conical partial surface 209, thus forming a second annular step 22. The third conical partial surface 309 transitions into a blind hole 30 from which the injection openings 11 lead. The valve needle 5 has a slightly altered valve sealing surface 7; it does once again have a first conical sealing surface 107 and a second conical sealing surface 207, but an annular groove 27 is provided between these two conical sealing surfaces 107, 207. The sealing edge 17 that comes into contact with the second conical partial surface 209 in the closed position of the valve needle 5 is formed at the transition between the annular groove 27 and the first conical sealing surface 107. The recessed third conical partial surface 309 achieves two things: on the one hand, it geometrically limits the effective seat area to the second conical partial surface 209, which makes it possible to precisely define and calculate the hydraulic ratios in the gap between the valve seat 9 and the valve sealing surface 7, particularly at the very beginning of the opening stroke motion. On the other hand, the recessed third conical partial surface 309 reduces the throttling action for the fuel flowing into the blind hole 30 that would otherwise be intensely throttled at the transition between the third conical partial surface 309 and the blind hole 30, which would reduce the injection pressure at the injection openings 11.

The height d of the annular step 21, as shown in FIG. 3, is preferably from 2 mm to 20 mm, which assures that on the one hand, the hydraulically effective seat diameter is precisely determined and on the other hand, the stability ratios in the region of the valve seat 9 of the valve body 1 remain unchanged. The width a of the second conical partial surface, as shown in FIG. 2, is preferably 0.2 mm to 0.5 mm.

There is considerable design latitude in the embodiment of the cone angles of the conical partial surfaces 109, 209, 309 of the valve seat 9. On the one hand, it is possible for all of the conical partial surfaces 109, 209, 309 to have an identical cone angle. However, it is also possible for them to have slightly different cone angles in order to optimize the influx properties of the fuel in the gap between the valve seat 9 and the valve sealing surface 7, particularly in order to optimally embody the inlet conditions of the fuel into the blind hole 30, as is the case in a fuel injection valve of the type shown in FIG. 4.

The foregoing relates to preferred exemplary embodiments of the invention, it being understood that other variants and embodiments thereof are possible within the spirit and scope of the invention, the latter being defined by the appended claims.

The invention claimed is:

1. In a fuel injection valve for internal combustion engines with a valve body (1) that contains a bore (3), which is delimited at its end oriented toward the combustion chamber by a valve seat (9) and whose end region oriented toward the combustion chamber has at least one injection opening (11), and with a piston-shaped valve needle (5), which is contained in the bore (3) in a longitudinally sliding fashion and has an essentially conical valve sealing surface (7) at its end oriented toward the combustion chamber, by means of which the valve needle (5) cooperates with the valve seat (9) so that when the valve needle (5) is resting against the valve seat (9), the at least one injection opening (11) is closed, and when the valve needle (5) is lifted away from the valve seat (9), fuel flows between the valve seat (9) and the valve sealing surface (7), then through the injection openings (11), the improvement wherein the valve seat (9) has a first conical partial surface (109) and a second conical partial surface (209), and wherein the second conical partial surface (209) is disposed downstream of and is raised in relation to the first conical partial surface (109), wherein the second conical partial surface (209) has the same cone angle as the first conical partial surface (109).

2. The fuel injection valve according to claim 1, wherein in its closed position, the valve needle (5) rests against the second conical partial surface (209).

3. The fuel injection valve according to claim 1, wherein the second conical partial surface (209) is raised by about 2 mm to 20 mm in relation to the first conical partial surface (109).

4. In a fuel injection valve for internal combustion engines with a valve body (1) that contains a bore (3), which is delimited at its end oriented toward the combustion chamber by a valve seat (9) and whose end region oriented toward the combustion chamber has at least one injection opening (11), and with a piston-shaped valve needle (5), which is contained in the bore (3) in a longitudinally sliding fashion and has an essentially conical valve sealing surface (7) at its end oriented toward the combustion chamber, by means of which the valve needle (5) cooperates with the valve seat (9) so that when the valve needle (5) is resting against the valve seat (9), the at least one injection opening (11) is closed, and when the valve needle (5) is lifted away from the valve seat (9), fuel flows between the valve seat (9) and the valve sealing surface (7), then through the injection openings (11), the improvement wherein the valve seat (9) has a first conical partial surface (109) and a second conical partial surface (209), and wherein the second conical partial surface (209) is disposed downstream of and is raised in relation to the first conical partial surface (109), wherein downstream of the second conical partial surface (209), the valve seat (9) is provided with a third conical partial surface (309), which is recessed in relation to the second conical partial surface (209).

5. The fuel injection valve according to claim 1, wherein the valve sealing surface (7) is provided with a sealing edge (17) that rests against the second conical partial surface (209) when the valve needle (5) is in the closed position.

* * * * *